United States Patent [19]

Stinson

[11] 4,273,392

[45] Jun. 16, 1981

[54] TISSUE ROLL HOLDER

[76] Inventor: Constance E. Stinson, 33 Franklin Ave., Quincy, Mass. 02170

[21] Appl. No.: 35,940

[22] Filed: May 4, 1979

[51] Int. Cl.[3] ..... A47F 3/02; B65D 85/672

[52] U.S. Cl. ..... 312/42; 312/45; 312/72; 312/207; 206/394

[58] Field of Search ..... 312/39, 42, 45, 43, 312/41, 72, 206, 207; 206/394

[56] References Cited

U.S. PATENT DOCUMENTS

| | | | |
|---|---|---|---|
| 894,685 | 7/1908 | McIsaac | 312/39 |
| 1,274,133 | 7/1918 | Ausubel | 312/206 |
| 1,361,842 | 12/1920 | Evslin | 312/206 |
| 1,676,356 | 7/1928 | Sapinsley | 312/42 |
| 1,788,348 | 1/1931 | Lemme | 312/43 |
| 2,215,850 | 9/1940 | Holdeman | 312/45 |
| 2,534,290 | 12/1950 | Moskowitz | 206/394 |
| 3,275,133 | 9/1966 | Wood | 312/42 |
| 3,413,049 | 11/1968 | Smay | 312/39 |
| 3,727,748 | 4/1973 | Brown | 312/206 |
| 4,008,933 | 2/1977 | Wanek | 312/42 |

*Primary Examiner*—Victor N. Sakran

*Attorney, Agent, or Firm*—Wolf, Greenfield & Sacks

[57] ABSTRACT

A holder for a plurality of tissue rolls, includes a support dowel or rod for holding the rolls in a stacked vertical array, and a cylindrical housing with a cover for containing the supported rolls. The support rod or dowel may be provided with a lift chain at the top thereof enabling one to lift the entire row array out of the storage housing.

1 Claim, 3 Drawing Figures

TISSUE ROLL HOLDER

BACKGROUND AND SUMMARY OF THE INVENTION

The present invention pertains to a holder for a plurality of rolls of toilet paper. The holder for this invention permits storage of a plurality of rolls in a vertical array and in a concealed manner within a container cylinder.

The storage of rolls of toilet tissue is often a problem requiring significant storage space either in a vanity, under a bathroom sink, or in a bathroom closet. Moreover, many times the rolls are left on top of the toilet closet which is quite unappealing from an aesthetic standpoint. Also, the number of rolls that can be stored convenient to the toilet is usually quite limited because of space limitations in the typical bathroom.

Accordingly, it is an object of the present invention to provide a holder for a plurality of tissue rolls wherein the rolls are supported in a concealed manner and yet are readily accessible.

Another object of the present invention is to provide a tissue roll holder including a support housing that may be decorated so that the holder has a very aesthetically pleasing appearance.

Still a further object of the present invention is to provide a toilet tissue holder that stores toilet rolls in a stacked vertical array whereby the holder takes up very little floor space.

Another object of the present invention is to provide a toilet tissue holder that is free-standing.

To accomplish the foregoing and other objects of this invention there is provided a tissue roll holder for holding a plurality of tissue rolls and comprising an elongated support member receiving the open core of the rolls, an elongated housing having base means permitting the housing to be free-standing in a vertical position and means at the top of the elongated support member for allowing removal of the tissue row array. The elongated support member which may be in the form of an elongated rod or dowel includes means permitting the rolls to be vertically stacked one on top of the next with all rolls being supported stantionary on the support member but being removable by lifting from the support member. In this regard the support rod may be provided with a plate at the bottom of the support rod fixed orthogonally to the support rod and having a diameter greater than the tissue roll core inner diameter. Each roll stacked above the other in turn supports the roll thereabove. The inner diameter of the elongated housing is greater than the maximum diameter of a tissue roll so that the stacked vertical array of rolls readily is accommodated in the elongated housing. The means for permitting removal of the tissue roll is dimensioned to permit removal of the rolls one at a time therepast. In this regard this latter means may comprise a lift chain secured to the top of the support rod. Also, the elongated housing is preferably cylindrical having a closed base and a top removable cover. The cover is preferably provided with a handle for easy removal thereof. For storage purposes the rolls are supported on the support rod and the stacked array is contained within the housing with the cover being disposed on the top thereof. By removal of the cover the stacked array can then be removed exposing the rolls. Then, one roll can be removed from the support rod for use. The remaining rolls of the stacked array can then be reinserted on the support rod into the housing for storage.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
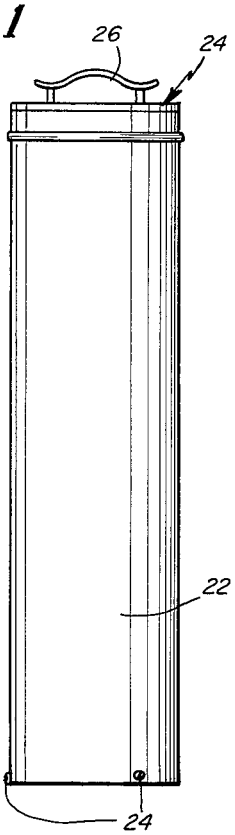
FIG. 1 is a front elevation view of the tissue roll holder of the present invention.
Figure 3:
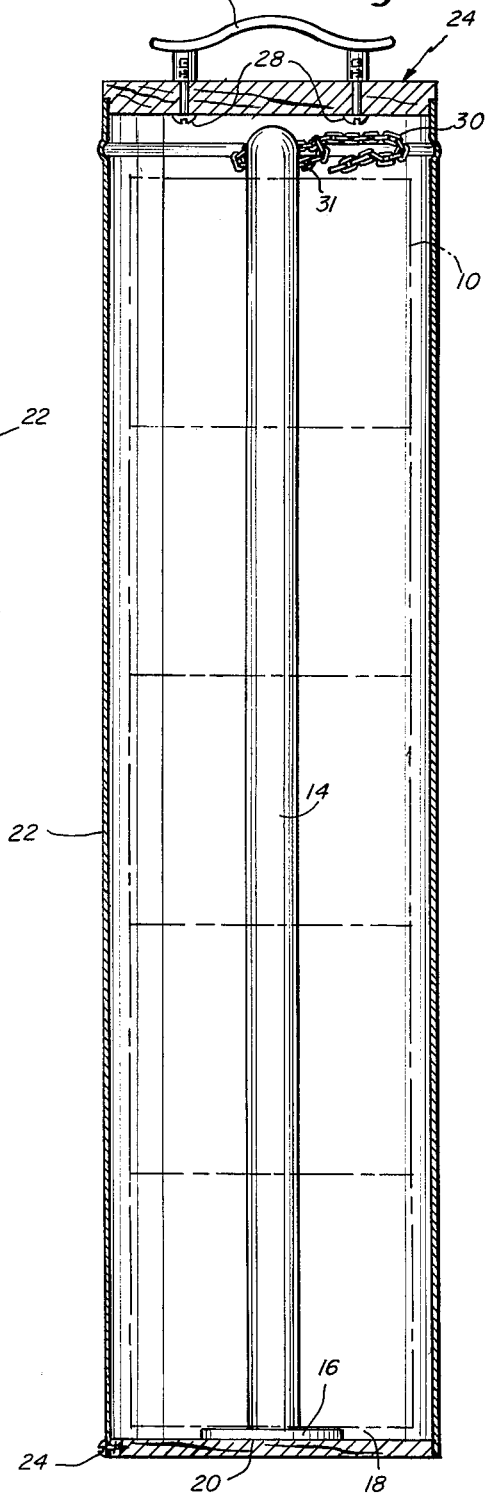
FIG. 3 is a cross-sectional view of the holder with the vertical tissue roll array stacked therein.
Figure 2:
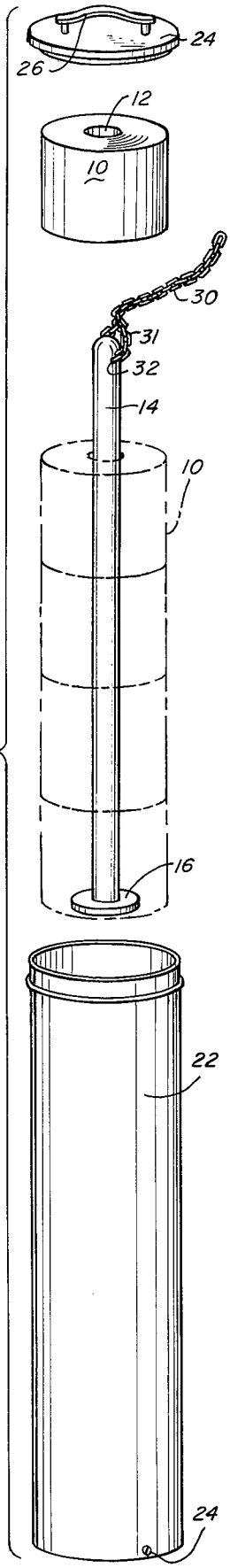
FIG. 2 is an exploded view of the tissue roll holder of FIG. 1.

The drawing shows a preferred embodiment of the tissue roll holder of the present invention. This embodiment has a height of approximately 24 inches and a diameter of approximately six inches. In alternate embodiments the holder could be made shorter or taller. The embodiment depicted in the drawing supports five toilet rolls 10. Each of these rolls is supported at its hollow center core 12 on the elongated support rod or dowel 14. The dowel 14 preferably has at its bottom end a flat circular plate 16 secured at the very bottom of the rod 14. The rod 14 and plate 16 may be constructed of wood but preferably are made of a light-weight plastic. The lowest row 10 rests upon the top of plate 16 and the other rows thereabove are stacked one on top of the next. The rod 14 thus has a length slightly longer than the height of five of these rolls. As depicted in FIG. 3 it is also noted that there is a gap 18 defined by the height of the plate 16 which is desired to provide air circulation about the rolls and elevate the bottom roll above the base 20. The base 20 forms a part of the cylindrical housing for the array of rolls. Because dust may accumulate on the top surface of the base 20 it is desirable to have the gap 18 so that the bottom roll 10 does not rest directly upon the base 20.

The container housing comprises a cylindrical tube 22 which is preferably of plastic. The base 20 may be of wood or plastic and is shown in this embodiment as being of wood secured by screws 24 to the very bottom of the tube 22. By means of the base 20 the bottom of the cylindrical housing 22 is thus closed. The top of the cylinder 22 is open and receives the cover 24 which has a peripheral channel so that the cover 24 snugly fits within the top end of the cylinder 22. The cover 24 is provided with a handle 26 which permits easy removal of the cover 24. The handle 26 is secured to the cover by means of a pair of screws 28. The cover 24 is shown constructed of wood but may also be constructed of plastic. The handle 26 may also be of a plastic material.

In order to provide easy removal of the stacked array of rolls there is provided a lift-out chain 30 which may have a length of approximately six and one-half inches. The chain 30 is formed at one end in a loop 31 which passes through a hole 32 at the top end of the support dowel 14.

Having described one embodiment of the present invention, it should now be apparent to those skilled in the art that numerous other embodiments are contemplated as falling within the scope of this invention. For example, the holder can be constructed entirely of plastic rather than using wood products. Also, the cylindrical housing 22 can be made in different lengths for supporting different numbers of tissue rolls.

What is claimed is:

1. A tissue roll holder for holding a plurality of tissue rolls comprising;

an elongated support rod receiving the open core of the rolls and including means permitting the rolls to be vertically stacked one on top of the next with all rolls being supported stationary on the support member but being removable by lifting from the support member, said support rod having a support plate at the bottom thereof having the lowermost roll supported thereon with the plate disposed orthogonally to the support rod and having a diameter greater than the tissue roll core inner diameter, an elongated cylindrical housing having a closed base permitting the housing to be free-standing in a vertical position, the inner diameter of the housing being greater than the maximum diameter of a tissue roll so that the stacked vertical array of rolls readily is accommodated in the elongated housing, said housing base forming a support for the support member plate thus elevating the bottom roll above the closed base by at least the thickness of the plate, means at the top of the elongated support member for allowing removal of the tissue roll array, in toto, said latter means comprising means adapted to be grasped and disposed at the very top end of the support rod, said manually graspable means being dimensioned to permit removal of the rolls one at a time therepast, and a top removable cover for closing the housing, said tissue rolls being supported primarily only on their base absent any side support.

* * * * *